US011794211B2

(12) United States Patent
Barnstedt

(10) Patent No.: US 11,794,211 B2
(45) Date of Patent: Oct. 24, 2023

(54) DEVICE AND METHOD FOR SEPARATING LIGHTWEIGHT MATERIAL FROM A TRANSPORT AIRFLOW

(71) Applicant: Dirk Barnstedt, Rötha (DE)

(72) Inventor: Dirk Barnstedt, Rötha (DE)

( * ) Notice: Subject to any disclaimer, the term of this patent is extended or adjusted under 35 U.S.C. 154(b) by 36 days.

(21) Appl. No.: 16/304,242

(22) PCT Filed: May 24, 2016

(86) PCT No.: PCT/DE2016/000222
§ 371 (c)(1),
(2) Date: Nov. 23, 2018

(87) PCT Pub. No.: WO2017/202397
PCT Pub. Date: Nov. 30, 2017

(65) Prior Publication Data
US 2020/0316648 A1 Oct. 8, 2020

(51) Int. Cl.
*B07B 7/083* (2006.01)
*B07B 11/06* (2006.01)
*B07B 13/16* (2006.01)

(52) U.S. Cl.
CPC ..... *B07B 7/083* (2013.01); *B07B 11/06* (2013.01)

(58) Field of Classification Search
CPC ..... B07B 7/083; B07B 11/06; B07B 13/16; B07B 7/10; B07B 7/06; B07B 1/20
USPC ..... 209/134
See application file for complete search history.

(56) References Cited

U.S. PATENT DOCUMENTS 896,230 A * 8/1908 Mueller ..... B07B 1/20 209/283
1,693,754 A * 12/1928 Henry ..... D01G 9/08 55/471
1,721,778 A * 7/1929 Hancock ..... D01G 9/10 55/432

(Continued)

FOREIGN PATENT DOCUMENTS

DE 1 510 850 1/1964
DE 27 41 059 3/1979

(Continued)

OTHER PUBLICATIONS

Carlos Gonzalez, "What's the Difference Between Pneumatic, Hydraulic, and Electrical Actuators?", Apr. 16, 2015, MachineDesign.com, https://www.machinedesign.com/mechanical-motion-systems/linear-motion/article/21832047/whats-the-difference-between-pneumatic-hydraulic-and-electrical-actuators (Year: 2016).*

*Primary Examiner* — Michael McCullough
*Assistant Examiner* — Molly K Devine
(74) *Attorney, Agent, or Firm* — Andrzej Malarz, Esq.

(57) ABSTRACT

A device (1) with which lightweight fractions, such as films or paper for example, being carried along in a carrier airflow (A) are separated and discharged for further processing. The device is characterized in that the housing can be easily opened by means of two pivotal cover hoods (3, 4) in order to allow maintenance work to then be carried out safely. The first cover hood (3) has an intermediate piece (31, 31') which extends into the housing and has chamfered surfaces (30, 30') at the ends, wherein the surfaces assuming a known specified angle α relative to the vertical, wherein the inner chamfer docks precisely against the chamfer of a guide element (27).

10 Claims, 5 Drawing Sheets

(56) References Cited

U.S. PATENT DOCUMENTS

Figure 1:
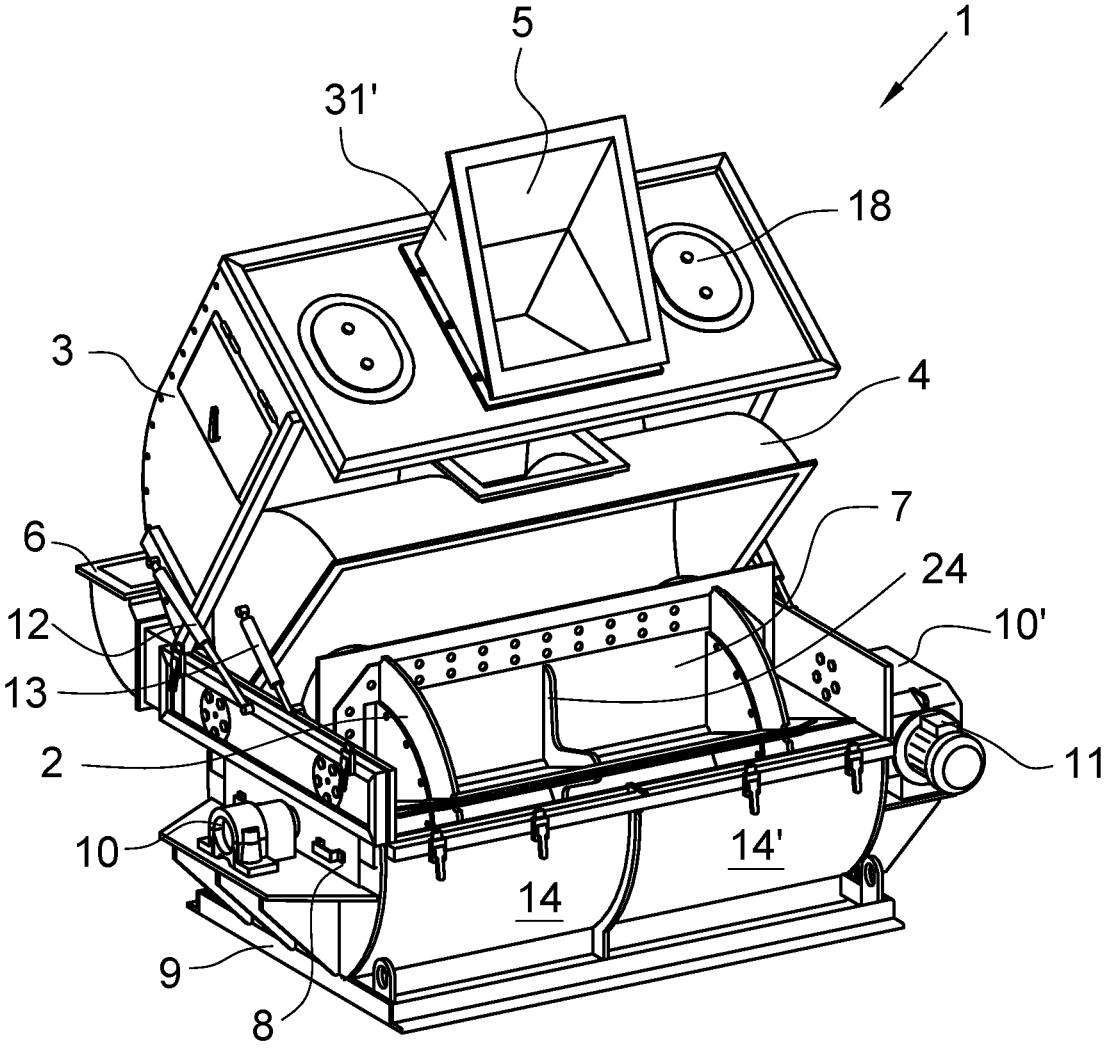

| | | | | | |
|---|---|---|---|---|---|
| 5,319,830 | A * | 6/1994 | Staheli | D01G 9/04 | 19/200 |
| 8,240,481 | B2 * | 8/2012 | Kato | B07B 1/20 | 209/284 |
| 2011/0287697 | A1 * | 11/2011 | Mase | B07B 4/08 | 451/67 |

FOREIGN PATENT DOCUMENTS

| | | | | |
|---|---|---|---|---|
| DE | 103 15 656 | A1 | 4/2004 | |
| EP | 0 447 966 | A1 | 9/1991 | |
| EP | 3090818 | A1 * | 11/2016 | B07B 13/16 |

* cited by examiner

DEVICE AND METHOD FOR SEPARATING LIGHTWEIGHT MATERIAL FROM A TRANSPORT AIRFLOW

The present invention deals with a device and an apparatus for separating light fraction, such as foils or paper, from a transport air flow, in particular with a device for reducing the assembly effort during maintenance and cleaning work.

Such devices are known in the state of the art from the publication DE 103 15 656 A1. This publication is a device for separating and conveying materials in a so-called cellular wheel sluice, in which a rotatatably mounted rotary wheel is arranged in a perforated sheet steel basket. The cell wheel has a number of elongated flat cell elements which divide the inner volume of the cellular wheel sluice into individual segments. Sealing lip elements are arranged at the ends of the cell elements and touch the inner surface of the wiper screens of the perforated sheet steel basket. An air injection device is positioned above the stripping sieves, which extends over almost half of the stripping sieves. This air injection unit feeds the material-laden air stream to the cell wheel, so that the large, light fractions of the material stream remain attached to the screen as a result of the air flow through the stripping sieves. Rotation of the cellular wheel, the light, stuck fractions are stripped off by the sealing lip elements and carried along and then fed to an opening in the lower area of the sieve drum or discharged without flow at the bottom via a discharge opening.

A disadvantage of this device has been shown to be that during maintenance work practically the entire system has to be dismantled in order to be able to remove both the screen surface as well as any fraction parts that have got stuck inside the screen drum. This often results in time-consuming faults which are technically very difficult to rectify. In order to eliminate these disruptions, the lower part of the cellular wheel sluice is opened during maintenance and cleaning work so that the maintenance person can reach into the inside of the drum from below to remove the remaining fractions. This type of maintenance work is cumbersome and extremely dangerous, because if the cellular wheel is switched on accidentally and unpredictably, serious injuries to the operator cannot be ruled out.

Furthermore, the German utility model specification G 85 05 540.9 has revealed a similar device to the aforementioned one with a cellular wheel sluice for separating finely divided solids from an air stream, a perforated sheet drum being surrounded by a cover box which, together with the perforated sheet casing, forms a circumferential air duct opening into the outlet for discharging the air stream.

This device also suffers from the above-mentioned disadvantages, so that the effective service life of such a device is severely limited at a constant differential pressure.

Furthermore, in the state of the art, the examined and published application DE 1 510 850 has revealed the existence of a cover over a double wire twisting spindle which can be folded down and consists of two parts. The cover is hinged to the housing so that it can be opened. In addition, the upper part of the cover can also be opened and is attached to the cover with a hinge.

Another example of a removable hood above a plastering machine can be found in the examined and published application DE 27 41 059. This is a device for picking up and conveying dry plaster in which a worm wheel is rotatably arranged in a housing. Above the housing in which the worm wheel is arranged, there is a cover with a number of feed openings through which both liquids and solids enter the inside of the housing to the worm wheel.

It is generally felt to be a disadvantage of the latter devices that the cover hoods always have to be removed with a relatively high technical effort and that the safety aspect is not sufficiently taken into account during necessary maintenance work in order to avoid serious injuries.

It is therefore the task of the present invention to provide a device and a process capable of safely maintaining the device and of carrying out the maintenance and replacement of wearing parts with a minimum of technical effort.

This task is solved according to the invention with the characteristic features of the main requirements.

In accordance with the invention, the device for separating light fractions from a transport air flow in a housing having at least one cover hood and at least one inlet opening and at least one guide element above a cellular wheel, is characterised in that at least the surface of the flow inlet opening of the guide element assumes a predetermined angle $\alpha$ to the verticals and at least one intermediate piece is arranged between the flow inlet opening and the first, at least one, cover hood.

This device is a light fraction separator for the separation of trenched materials such as paper, foil or cardboard waste from a transport air stream. The air stream loaded with recyclable materials is blown into the material separator. The coarse material remains hanging on a perforated grid and is discharged from the unit via a cellular wheel sluice with scrapers. The dust-laden air leaves the separator via a special exhaust pipe and is returned to the fan. Two large side inspection doors allow at least easy cleaning or inspection of the cellular wheel sluice and the perforated grid.

The process in accordance with the invention for separating light fractions from an air flow (A) in a housing with at least one cover and at least one inlet opening and at least one guide element above a cellular wheel is characterised by the following process steps:

- Introducing an air flow (A) loaded with at least one light fraction into an housing through at least one inlet nozzle;
- Deflection of the support air flow (A) by means of a bent guide element (27) into a cellular wheel sluice (7) in which a cellular wheel (2) with at least one division element (24) is set;
- Outlet of the air stream (A) from the cellular wheel sluice (7) via a perforated plate (20'), wherein the light flat fractions, for example foils, are separated;
- Stripping and discharging the light fractions from the inner wall of the cellular wheel sluice (7) by means of at least one arm (24) on the rotating feeder (2) inside the cellular wheel sluice (7).

This process is used in the paper/disposal and foil industry and in related industries to separate light fractions (foils, paper, cardboard and similar) from a transport air flow. The light fractions can then be fed to a conveyor belt, container, press or similar downstream systems. During operation, the light fractions (sifted material) are sucked into the light fraction separator together with air containing dust. Coarse material and some of the dust carried along are continuously discharged via a rotating feeder. The dust-laden air blown in flows through the perforated plate separator and leaves the housing of the material separator by overpressure or underpressure, depending on the system configuration.

It has been shown to be advantageous that at least one cover can be folded in order to get to the cellular wheel sluice with just a few hand movements and without loosening screw connections.

It is important and advantageous that the power supply to the drive components is effectively switched off by means of a monitoring switching element when at least one cover is opened.

It is also advantageous that at least one cover has at least one pipe union. This, at least one, pipe union is intended to produce a screwless line for the transport air flow into the housing.

A further advantage is seen in the fact that the pipe union is annular in shape and has annular sealing elements to produce an almost airtight connection, whereby annular is not necessarily to be understood as round.

It is also advantageous that the surface of the second cover is at least partially formed by a perforated steel plate, through which the amount of air flowing into the cellular wheel sluice can escape again.

It is also advantageous that the second cover hood is adapted to the geometric dimensions of the cell wheel to be covered in order to increase the effectiveness of the lip seals for wiping off the screened light fractions.

It is also advantageous that the opening of the conductive element is adapted in its geometric dimensions to those of the intermediate piece. This measure ensures that when both the first and the second cover are closed, an almost airtight seal of the carrier air flow is effectively created as a result of the assembly.

Another advantage is that the two cover hoods each have at least one joint, for example a hinge, whose axes of rotation are arranged in parallel and on the same opposite side of the flow inlet opening. This ensures that when the two covers are lifted, the cellular wheel in the cellular wheel sluice is freely accessible from above. This is a particular advantage of the present invention, because it prevents the cell wheel from rotating when one or the other cover hood is opened, because a monitoring sensor is arranged on each cover hood, which causes an immediate interruption of the power supply for the drive of the cell wheel.

It is also advantageous that the suction nozzle for the exhaust air is arranged on the same side as the hinge axes of rotation, which leads to considerable simplifications and simplifications in design. In addition, it is a particular advantage that the suction nozzle is mechanically stable enough to accommodate at least one hinged cover without endangering the stability of the entire device. As a result of the mechanically load-bearing design and construction of the suction nozzle, the entire mechanical structure and construction of the cover hoods, together with the suction nozzle, are given a particularly simple and advantageous design, enabling compact construction.

It is also advantageous that the conductive element at least partially encloses the surface of the second cover in the form of a wedge. This ensures a relatively balanced flow distribution to the cell wheel or the individual cells.

A further advantage is that at least one inspection flap is arranged on the first cover of the housing, so that at least minor maintenance work can be carried out when the flap is opened.

Another advantage is that the first and second covers are guided by a spring support element, which means that the covers can be opened relatively easily by an operator.

It is also advantageous that at least one cover can be closed using at least one clamping element, e.g. a tension clamp. Such a fastener has the decisive advantage of opening the covers relatively quickly on the one hand and exerting relatively uniform mechanical pressure at all points of the seals on the other.

It is also advantageous that at least one hinged inspection flap is arranged below the inlet opening, which can also be opened and closed using tension clamps, for example. At the same time, this makes it possible to check the function of the entire device.

A further advantage can be seen in the fact that at least one intermediate piece for guiding the air flow carrier (A) is arranged on at least one swivelling cover hood. This intermediate piece has the essential task of enabling the flow connection between the outer flow line and the guide element for the uniform introduction of the air flow into the cellular wheel sluice. For this purpose, it is necessary that a sealing element is arranged between the conductive element of the guide element and the intermediate piece which does not require any screw connections, for example two flat annular flat metal surfaces which are joined together in a blunt or profiled manner.

It is also advantageous that the connecting surfaces of the intermediate piece and those of the conductive element take up a predetermined angle $\alpha$, $\alpha'$ to the vertical in order to ensure an effortless coupling to the air guidance system at all.

A further advantage is that the swivelling covers of the housing and the cellular wheel sluice have at least one pressure support element at a suitable location which is operated electrically, pneumatically, hydraulically or by spring pressure.

It is also advantageous that the upper side of the conductive element has a closed guide plate and the side covers are made of perforated plates so that no periodic flow oscillations occur with a strong carrier air flow, which can have a negative effect on the entire air supply network.

Figure 2:
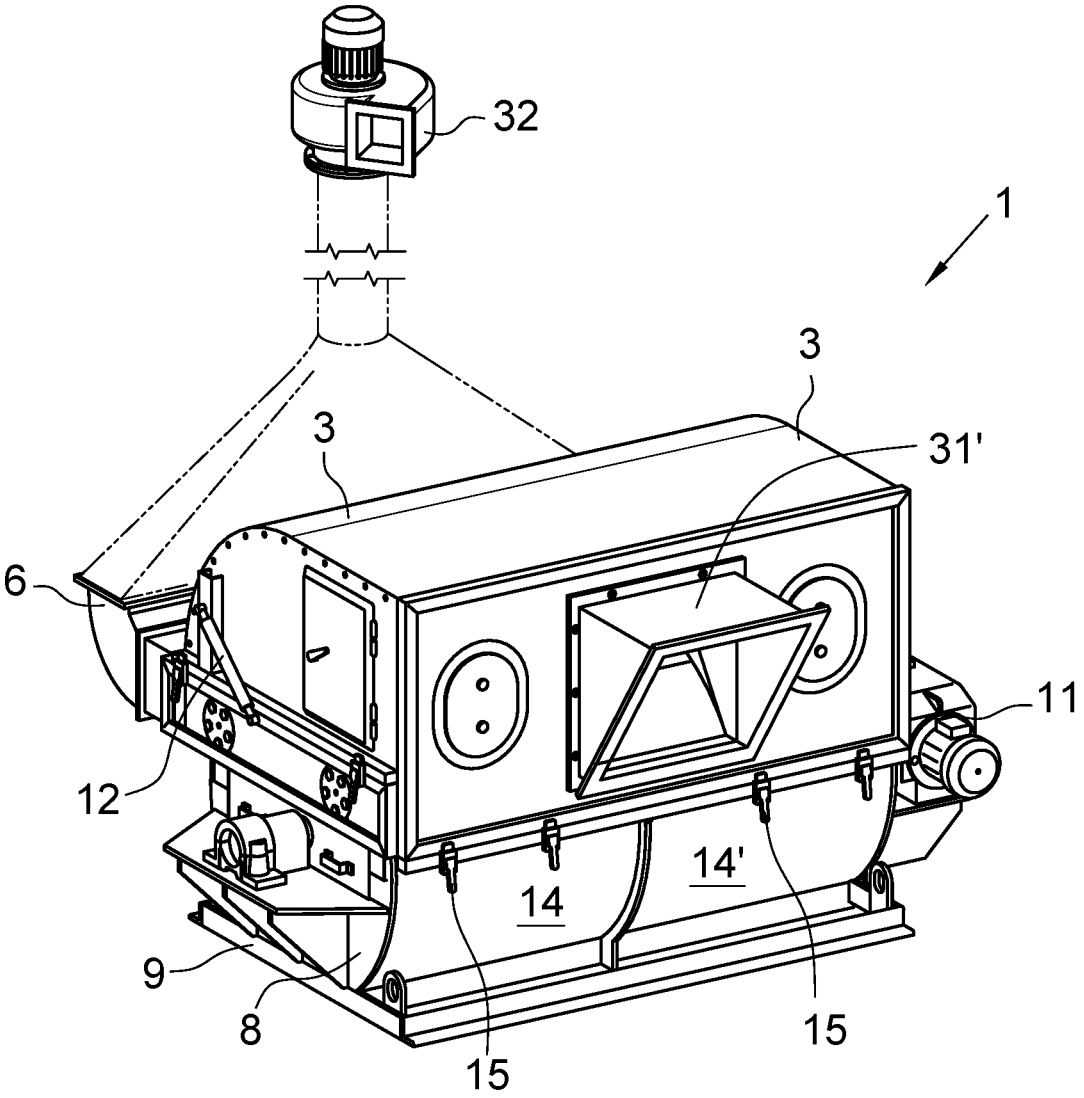
Figure 3:
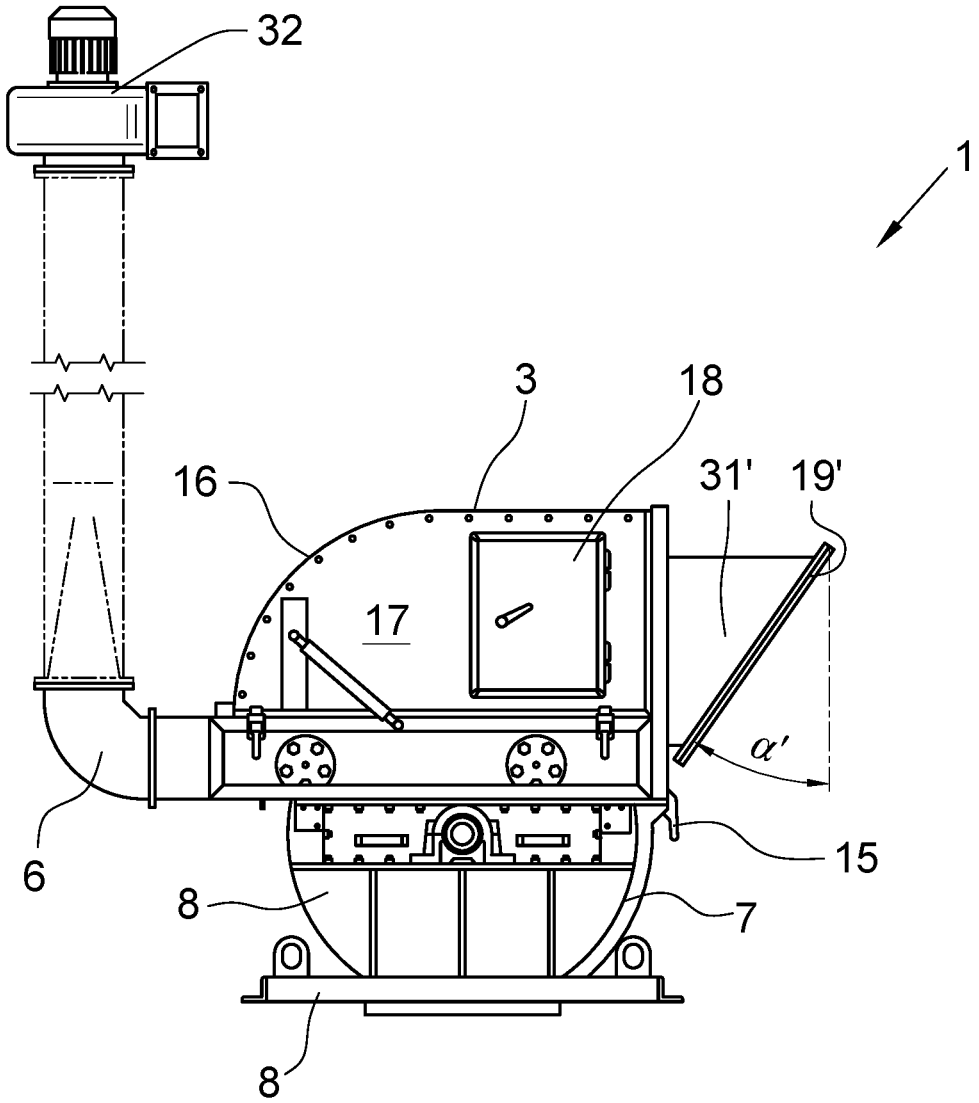
Figure 4:
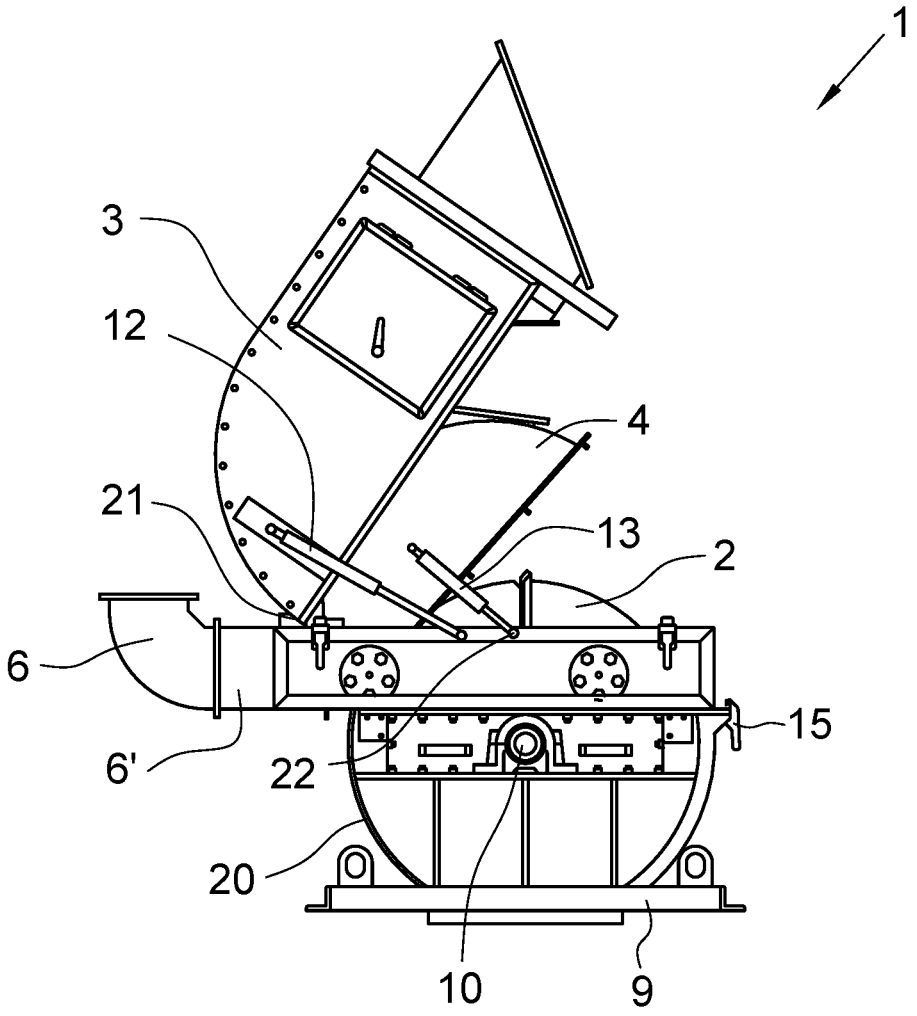
Figure 5:
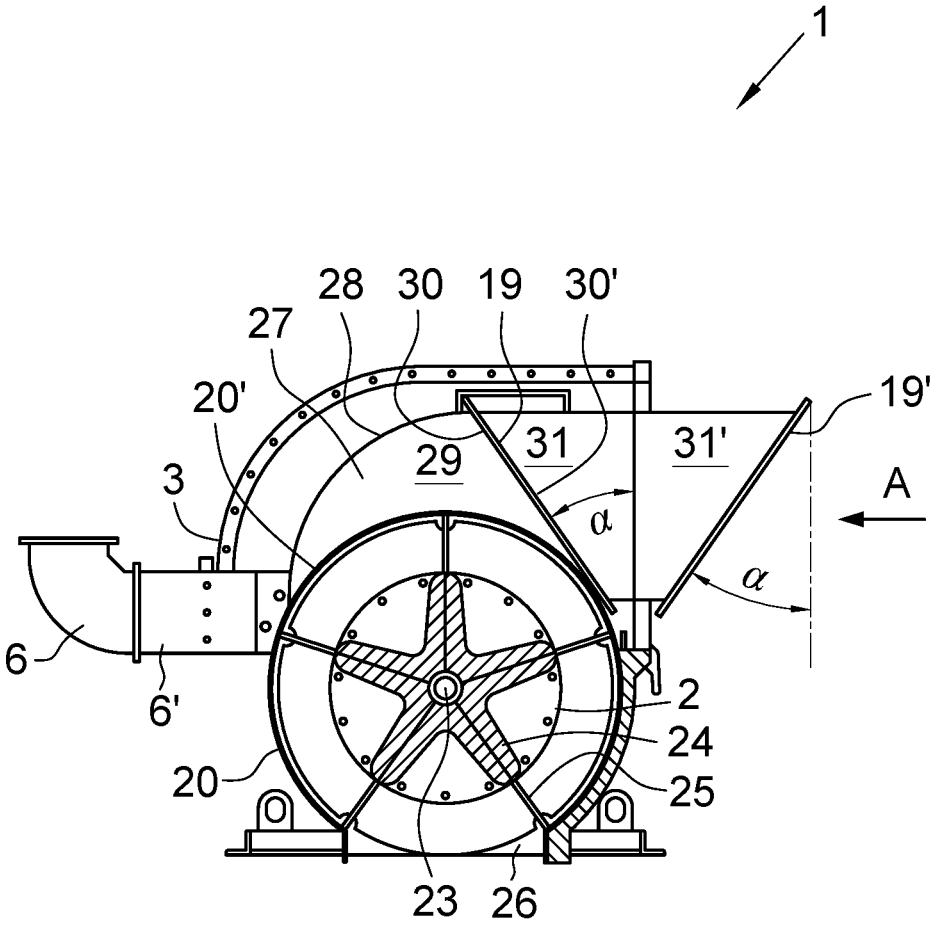

In the following, the invention will be explained in detail on the basis of figures. It shows:

FIG. 1 a perspective representation of the device (1) with a cellular wheel (2) in a housing with at least two cover hoods (3, 4) in the opened state;

FIG. 2 a perspective representation of the device (1) in the closed state;

FIG. 3 is a schematic side view of the device (1) with an intermediate piece (31) and an outlet nozzle (6) positioned above the cellular wheel (2);

FIG. 4 a schematic side view of the device (1) when the two cover hoods (3, 4) are opened;

FIG. 5 a schematic sectional view of the device (1) in the closed state of the two cover hoods (3, 4) positioned above the cellular wheel (2).

FIG. 1 shows a perspective view of device 1 with a cellular wheel 2 in a cellular wheel sluice 7, which is described in more detail below. The cell wheel 2 is rotatably mounted in a housing 8. The housing is essentially supported by a supporting structure which is mounted on a base frame 9. The bearings 10, 10' of the cellular wheel 2 are arranged at the side of the cellular wheel on the supporting structure. The drive 11 of the cellular wheel 2 is arranged in the immediate vicinity of the bearing 10' or the gear unit. The two cover hoods 3,4 are hinged in the area of the suction pipe of the outlet nozzle 6. The covers 3, 4 each have laterally arranged pressure supports 12, which considerably facilitate the opening of the relatively heavy cover and at the same time support the guidance of the covers 3, 4. Two inspection flaps 14, 14' are arranged in the lower area of the housing, which serve to facilitate easy maintenance work.

FIG. 2 shows a perspective view of device 1 in the closed state. Here the two cover hoods 3, 4 are arranged in their intended working position, whereby the outer cover hood 3 is kept closed with the aid of tensioning elements 15. The main purpose of the tensioning elements 15 is to open the cover 3 quickly and safely so that possible maintenance work can be carried out quickly. The surface of the air inlet opening on the inlet nozzle 5 is inclined at a predetermined angle α to the vertical in order to allow an advantageous coupling of the nozzle 5 to the flow control system without screw connections or other fastening means which can only be operated with tools. FIG. 2 shows also a fan 32 (not shown in FIGS. 1, 4 and 5).

FIG. 3 shows a schematic side view of device 1 with an inlet port 5, and an outlet port 6. The top cover of the first cover 3 is arched in the rear part 6 in order to create favourable flow conditions inside the housing. This prevents greater turbulence inside the housing. The side walls 17 of the first cover 3 are essentially flat metal sheets on which an inspection door 18 is arranged in a suitable position. The surface 1.9 of the inlet opening of the inlet connection 5 occupies a predetermined angle α' to the vertical. In principle, it is irrelevant whether the surface 19 has an inclination or an inclination. As a result of the inclination, the weight of the cover 3 is reduced, which has a positive effect on the opening of the cover.

FIG. 4 shows a schematic side view of device 1 when the two covers 3, 4 are opened. The cellular wheel sluice, which forms part of the housing, consists in the lower part of a closed sheet metal 20 in the shape of a circular arc, which is fastened and mounted on the base construction 9. The flow outlet nozzle 6, in this illustration on the left side, is arranged slightly above the centre of the rotary valve 7 for flow reasons. To gain access to the cell wheel 2 within the cell wheel sluice 7, first loosen the tensioning elements 15 of the first cover 3 and then lift the cover 3 with the support of the pressure elements 12. The joints 21 of the first cover 3 are located above the outlet connection 6.

At least part 6' of the outlet connection 6 is mechanically stable enough to withstand the loads of the upper cover 3 and the lower cover 4. The joints 21 (not shown) of the second cover hood 4 are arranged at approximately the same height as the lower side of the outlet nozzle 6', which offers considerable design advantages. The pressure support elements 13 of the second cover 4 are fixed at one end to the edge of the second cover 4 and at the other end 22 to the support structure for the bearing 10, 10' of the cellular wheel 2.

FIG. 5 shows a schematic side view of device 1 in the closed state. On the axis 23 of the cellular wheel 2, five arms 24 are arranged radially in the form of a star at equal angular spacings, at each end of which a lip seal 25 is attached, which lightly touch the inner side of the cellular wheel sluice 7. As already mentioned above, the lower half of the cellular wheel sluice 7 is made of a closed sheet metal 20, which has a material outlet opening 26 in the lower area, through which the light fractions, such as paper or foil, striped off by the upper part 20', are discharged.

Over the upper half of the wheel sluice 7, a perforated 20' plate extends over the entire length, from which the blown air flow can at least partially escape. The flat, light fractions carried by the carrier flow remain attached to the grid of the perforated plate 20' and are then carried along by the lip seals 25, as the cellular wheel 2 rotates, and discharged through the material outlet opening 26. A conductive element 27 extends over a part of the surface of the sieve-shaped part 20' of the cellular wheel sluice, approximately in the middle of the drum, over the upper part 20' of the cellular wheel sluice 7. The guide element 27 is curved and wedge-shaped and extends at least partially over the surface of the screen plate 20'.

The upper part 28 of the conductive element 27 is a closed plate without openings, in contrast to the lateral walls 29 of the conductive element, which are made of a perforated plate. The purpose of these perforated plates is to balance the relatively large volumes of air in the air flow to escape, so as to prevent periodic oscillations from occurring within the casing and the flow lines. The conductive element 27 terminates with an annular sealing surface 30 which is at a predetermined angle α to the vertical. The annular sealing surface 30, which extends around the inlet opening of the guide element 27, has exactly the same geometrical dimensions as the wedge-shaped intermediate piece 31, 31' docked to it in side view, which is attached to the first cover hood 3. The second part of the wedge-shaped intermediate piece 31' practically forms an extension of the intermediate piece. In practice, the extension of this intermediate piece 31' forms the inlet connection for the carrier air flow A, which is composed of a mixture of air and solids. The surface 10' of the end of the intermediate piece 31' also has an inclination with the angle α to the vertical, so that the entire intermediate piece, in this case consisting of two parts, is wedge-shaped in order to minimise the weight of the hinged cover 3. A sealing element for sealing the flow line is provided on each of the connection surfaces 10,10'.

In summary, it may be stated that the present invention introduces a device 1 which separates light fractions, such as foils or paper, in a carrier air stream A and then discharges them in a way that they can be reused. This device is characterised by the fact that the housing can be opened effortlessly by two hinged cover hoods 3.4 without the use of any tools, so that maintenance work can then be carried out safely. The first cover 3 has at least one intermediate piece 31, 31' which extends into the housing of the device 1 and has at its ends inclined surfaces 30, 30' which occupy a certain predetermined angle α to the vertical, the inner incline docking exactly to the incline of a guide element 27. As a result of the arrangement of the intermediate piece 31, 31', it is possible to safely clean and maintain the device in just a few steps.

The invention claimed is:

1. Device suitable for separating light fractions from a material-laden airflow in a housing having two pivotable hinged cover hoods and at least one of two flow inlet openings and a guide element above a cellular wheel sluice, wherein the surface of a flow inlet opening area of the guide element forms a predetermined angle α, α' with the vertical and has at least one of two inclined intermediate pieces between the guide element, and the at least one of two flow inlet openings, wherein at least one of said inclined intermediate pieces is arranged on a first outer pivotable hinged cover hood, wherein each of the two pivotable hinged cover hoods has at least one hinge, with a parallel axis of rotation arranged on the same opposite side of the at least one of two flow inlet openings of the at least one of two inclined intermediate pieces, wherein the two pivotable hinged cover hoods are placed on top of each other, wherein a suction nozzle is arranged on the same side as the axis of rotation of the at least one hinge; wherein the suction nozzle is designed in such a way that at least one hinge of the two pivotable hinged cover hoods is mounted above the suction nozzle;

wherein the guide element partially encloses a surface of a second inner pivotable hinged cover hood in a wedge-shaped manner forming a uniform air pressure over the cellular wheel sluice, wherein the guide element extends over a part of the surface of a sieve-shaped part of the cellular wheel sluice, approximately in the middle of a circular drum, over the upper part of the cellular wheel sluice, wherein an upper side of the guide element is composed of a closed arcuate guide plate and lateral walls which form perforated plates, wherein lip seals are arranged on the cellular wheel sluice to strip off the light fractions that stuck to an inner wall of the cellular wheel sluice and to discharge the light fractions from the cellular wheel sluice through an outlet opening, wherein the first outer pivotable hinged cover hood has the at least one of two inclined intermediate pieces which extends into the housing of the device allowing the at least one of two inclined intermediate pieces to be lifted with the first outer pivotable hinged cover hood by hand as a total weight of the first outer pivotable hinged cover hood is reduced due to inclined surfaces at ends of the at least one of the two inclined intermediate pieces, wherein the at least one of two flow inlet openings of the at least one of two inclined intermediate pieces are annular and have annular sealing elements on edges of surfaces of the at least one of two inclined intermediate pieces which seal the inclined surfaces of the at least one of two inclined intermediate pieces by forming an airtight connection of said surfaces with one another, wherein a fan is arranged outside of the device.

2. Device according to claim 1, wherein the surface of the second inner pivotable hinged cover hood is formed partially by a perforated steel plate.

3. Device according to claim 1, wherein the second inner pivotable cover hood is adapted to the geometric dimensions of a cellular wheel to be covered.

4. Device according to claim 1, wherein the flow inlet opening area of the guide element is adapted to the opening of the at least one of two inclined intermediate pieces.

5. Device according to claim 1, wherein the two pivotable hinged cover hoods are closed by means of a clamping element, in the form of a tension clamp.

6. Device according to claim 1, wherein at least one hinged inspection flap is arranged below the at least one of two flow inlet openings.

7. Device according to claim 1, wherein at least one connecting surface of the at least one of two inclined intermediate pieces and at least one connecting surface of the guide element forms predetermined angles $\alpha$, and $\alpha'$ with the vertical.

8. Device according to claim 1, wherein the two pivotable hinged cover hoods of the housing and the cellular wheel sluice have at least one pressure support element which is operated electrically, pneumatically, hydraulically or by spring pressure.

9. Device according to claim 1, wherein the two pivotable hinged cover hoods are closed by means of tensioners.

10. Method for separating light fractions from a material-laden airflow in a housing having two pivotable hinged cover hoods and at least one of two flow inlet openings and a guide element above a cellular wheel sluice, comprising the following steps:

introducing the material-laden airflow loaded with at least one light fraction into a housing through at least one of two inclined intermediate pieces;

deflecting the material-laden airflow loaded with at least one light fraction by means of the guide element forming a uniform air pressure over said cellular wheel sluice in which at least one dividing element is arranged, wherein the guide element consists of a closed upper part without openings to secure laminar air flow;

leaving the material-laden airflow, loaded with at least one light fraction, from the cellular wheel sluice via a perforated plate, resulting in separation of light fractions;

stripping and discharging the light fractions from the inner wall of the cellular wheel sluice by means of at least one dividing element on the cellular wheel inside the cellular wheel sluice; wherein the light fractions are distributed evenly in the cellular wheel sluice; wherein lip seals are arranged on the cellular wheel sluice to strip off the light fractions that stuck to an inner wall of the cellular wheel sluice and to discharge the light fractions from the cellular wheel sluice through an outlet opening;

opening the first outer pivotable hinged cover hood without any tools by hand as a total weight of the first outer pivotable hinged cover hood is reduced due to inclined surfaces at ends of the at least one of two inclined intermediate pieces; wherein the guide element partially encloses a surface of the second inner pivotable hinged cover hood in a wedge-shaped manner forming a uniform air pressure over the cellular wheel sluice, wherein an upper side of the guide element is composed of a closed arcuate guide plate and lateral walls which form perforated plates; and arranging the at least one of two inclined intermediate pieces for guiding the material-laden airflow on the two pivotable hinged cover hoods; wherein the surface area of inlet and outlet openings of the at least one of two inclined intermediate pieces form a predetermined angle $\alpha$, $\alpha'$ with the vertical.

* * * * *